US006114260A

United States Patent [19]

Kim

[11] Patent Number: 6,114,260

[45] Date of Patent: Sep. 5, 2000

[54] AIR-PERMEABLE SHEET STRUCTURAL MATERIAL, LEATHER-LIKE SHEET STRUCTURAL MATERIAL AND METHOD OF PRODUCING THE SAME

[75] Inventor: Soojin Kim, Kobe, Japan

[73] Assignee: Koatsu Cloth Co., Ltd., Kobe, Japan

[21] Appl. No.: 09/115,713

[22] Filed: Jul. 15, 1998

[30] Foreign Application Priority Data

Jul. 18, 1997 [JP] Japan ..... 9-209926
Jan. 29, 1998 [JP] Japan ..... 10-33952

[51] Int. Cl.[7] ..... B32B 5/18; B05D 3/02

[52] U.S. Cl. ..... 442/76; 442/221; 442/227; 442/286; 427/373; 427/385.5; 427/389.9

[58] Field of Search ..... 442/76, 221, 227, 442/286; 427/373, 385.5, 389.9

[56] References Cited

U.S. PATENT DOCUMENTS 4,029,534 6/1977 Bocks et al. ..... 156/246

FOREIGN PATENT DOCUMENTS 51-3764 5/1976 Japan ..... D06N 3/04
05071080 3/1993 Japan ..... D06N 7/00
08232174 9/1996 Japan ..... D06N 3/14

*Primary Examiner*—Christopher Raimund
*Attorney, Agent, or Firm*—Marshall, O'Toole, Gerstein, Murray & Borun

[57] ABSTRACT

Sheet structural material and leather-like sheet structural material which have a porous layer formed by applying a foamed material having a thixotropy index of 2 to 4 and drying the foamed material and a method of producing the same, are disclosed. The foamed material is prepared by foaming a compound solution containing at least a base resin and a filler. The porous layer has open cells and the diameter of the open cells is in the range from 20 to 250 micrometer. The air permeability of the resulting sheet structural material is 3 to 13 $cm^2/cm^3/sec$.

12 Claims, 5 Drawing Sheets

AIR-PERMEABLE SHEET STRUCTURAL MATERIAL, LEATHER-LIKE SHEET STRUCTURAL MATERIAL AND METHOD OF PRODUCING THE SAME

FIELD OF THE INVENTION

The present invention relates to a sheet structural material and leather-like sheet structural material, which are superior in air permeability and can be used in artificial leather, and to a method of producing the same. More particularly, the present invention relates to a sheet structural material and leather-like sheet structural material, wherein noticeably high air permeability has been imparted by forming a porous layer having open cells on a supporting fabric, and to a method of producing the same.

BACKGROUND OF THE INVENTION

Since natural leather is superior in durability and air permeability, it has been used in various articles, such as clothes, shoes, and the like, to take advantage of these properties. However, since natural leather is expensive, a leather-like sheet structural material is developed as a substitute for natural leather. At present, the leather-like sheet structural material is widely used as artificial leather in clothes, shoes, and the like.

However, since artificial leather is produced by forming a film layer on a sheet structural material comprising a supporting fabric and a porous layer formed on the supporting fabric, it is inferior in air permeability and feeling compared to natural leather at present. To solve this problem, the present inventors previously invented artificial leather having feeling and air permeability similar to those of natural leather (Japanese Patent Kokai Publication No. 8-232174). Artificial leather described in this publication is characterized in that a concavo-convex portion is formed on the surface of a sheet structural material having a porous layer, and a film layer is formed only on the convex portion of the concavo-convex portion of the surface, thereby forming a leather-like appearance. With this constitution, since a film layer is not formed on the concave portion of the surface of the porous layer, good air permeability and appearance like leather are provided.

According to such a constitution, there can be obtained artificial leather having the same air permeability as that of natural leather. Natural leather and artificial leather are durable, but are inferior in air permeability to a normal cloth. Therefore, when they are used in shoes, the air permeability is inferior to that of shoes made of a cloth. Accordingly, it is envisioned that usage of artificial leather can be increased by developing a sheet structural material wherein the air permeability is further improved while maintaining an appearance similar to natural leather.

The porous layer to be formed on the supporting fabric has hitherto been formed by applying a coating solution containing a base resin and dimethylformamide (hereinafter abbreviated to "DMF") as a solvent on the supporting fabric and dipping in water to remove DMF. According to this method, environmental pollution problems arose, such as wastewater disposal, recovery of DMF, and the like. Furthermore, since the method using DMF includes a step of drying after dipping in water, it was necessary to practice a step which is complicated and requires large energy consumption.

An object of the present invention is to solve these problems of the prior art, and to provide a sheet structural material and a leather-like sheet structural material, which are suited to produce artificial leather having air permeability superior to natural leather, and to a method of producing the same. Another object of the present invention is to provide a sheet structural material and a leather-like sheet structural material, which can be produced by a comparatively simple production step without causing environmental pollution problems, and to a method of producing the same.

SUMMARY OF THE INVENTION AND DESCRIPTION OF THE PREFERRED EMBODIMENTS

Figure 1A:
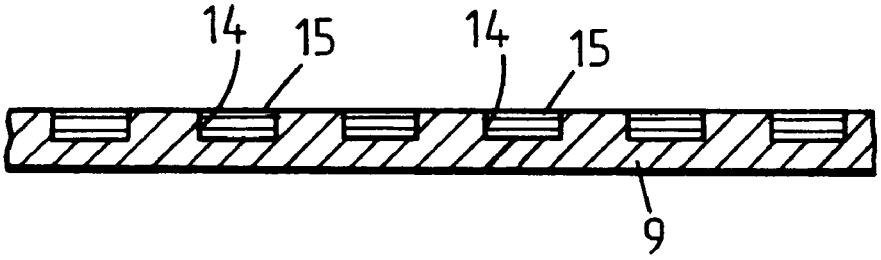
Fig. 1a (Prior Art)
FIGS. 1(*a*) and 1(*b*), respectively, are sectional views showing a leather-like sheet structural material of the present invention.

The sheet structural material of the present invention comprises an air-permeable supporting fabric and a porous layer formed on said supporting fabric, wherein open cells are formed on the porous layer and the diameter of the open cells are in the range from 20 to 250 micrometer. By forming open cells of such a size, a sheet structural material having air permeability, which is noticeably superior to that of a sheet structural material of the prior art, can be obtained. Regarding the sheet structural material of the present invention, the air permeability of the sheet structural material is within the range from 10 to 20 cm3/cm2/sec, which is considered high.

The term "air permeability" used in the present invention refers to a numerical value obtained by measuring the method described in JIS L-1096.

Such a porous layer is formed, for example, by applying a foamed material having a thixotropy index of 2 to 4, and which is obtained by foaming a compound solution containing at least a base resin and a filler, and drying the foamed material.

The term "thixotropy index" used in the present invention refers to a ratio of a viscosity $\eta 12$ measured at 12 revolution/sec to a viscosity $\eta 60$ measured at 60 revolution/sec using a B-type rotatory viscometer, that is, a numerical value obtained from $\eta 12/\eta 60$.

The leather-like sheet structural material of the present invention is characterized in that a leather-like concavo-convex surface is formed on the surface of the porous layer of the above sheet structural material, and a film layer is formed on the convex portion of this concavo-convex surface. Consequently, the leather-like sheet structural material of the present invention secures the air permeability by the concave portion where the film layer is not formed, thereby accomplishing high air permeability ranging from 3 to 13

$cm^3/cm^2/sec$. Because the air permeability of normal natural leather is not more than 1.0 $cm^3/cm^2/sec$, the leather-like sheet structural material of the present invention has excellent air permeability.

A sheet structural material of the present invention comprises an air-permeable supporting fabric and a porous layer formed on the supporting fabric. The porous layer has open cells and a diameter of an open cell is within the range from 20 to 250 micrometer. The air permeability of the sheet structural material of the present invention is in the range from 10 to 20 $cm^3/cm^2/sec$.

As the air-permeable supporting fabric, there can be used nonwoven fabric, woven fabric, knit, or the like. As the supporting fabric for leather-like sheet structural material, a nonwoven fabric typically is used. Examples of the nonwoven fabric include those produced by the water jet method, span lace method, needle punch method, or the like, and any nonwoven fabric can be used in the present invention.

The porous layer to be formed on the air-permeable supporting fabric is formed by applying a foamed material having a thixotropy index of 2 to 4, which is obtained by foaming a compound solution containing at least a base resin and a filler, and drying the foamed material. The viscosity of the foamed material is preferably in the range from 5,000 to 35,000 centipoises, more preferably from 16,000 to 22,000, and particularly from 18,000 to 20,000. When the viscosity of the foamed material is smaller than 5,000 centipoises, cells are liable to broken in case of forming the porous layer. On the other hand, when the viscosity is larger than 35,000 centipoises, it becomes substantially impossible to apply the foamed material on the supporting fabric.

The compound solution before foaming preferably has a viscosity within the range from 5,000 to 30,000 centipoises, and more preferably from 12,000 to 15,000 centipoises. It is preferred to use the compound solution having a viscosity within such a range in order to obtain the foamed material having a viscosity within the above range.

Furthermore, the expansion ratio of the compound solution preferably is from 1.3 to 2.5. When the expansion ratio is smaller than 1.3, the resulting sheet structural material becomes hard and is not suitable as a sheet for leather. On the other hand, when the expansion ratio is larger than 2.5, a peeling strength between the supporting fabric and porous layer of the resulting sheet structural material is unfavorably lowered.

In case of a use requiring a large peeling strength between the supporting fabric and porous layer, i.e., in sports shoes, the expansion ratio preferably is within the range from 1.4 to 1.7. It is preferred to use polyurethane as the base resin described hereafter in order to provide flexibility.

It is preferred that the compound solution used to form the porous layer contains, in addition to the base resins and fillers, dispersants, foam stabilizers, foaming assist agents, thickeners, etc., in order to adjust the thixotropy index and viscosity within the above range. It is also preferred that the porous layer to be formed contains elasticizers for imparting elasticity, and crosslinking agents for crosslinking the base resin. The elasticizer acts to prevent such a phenomenon wherein cells to be formed are broken by pressure and walls of the cells are adhered each other, and, as a result, the cells are not returned to the original state. Furthermore, it is possible to optionally add various additives, such as a pigment or the like, in the production of the leather-like sheet structural sheet, as a matter of course.

As the base resin present in the compound solution, those having good foamability are suitable. Examples thereof include an acrylic polymer, such as polyacrylate ester, polymethacrylate ester, copolymer thereof or the like; diene polymer, such as synthetic rubber, natural rubber, latex or the like; polyurethane; or a mixture thereof. This base resin can be used in the form of an emulsion or dispersion. As the base resin, those having high solid content, low TG (glass transition temperature), good frothing property, and small content of defoamer are suitable in view of the above foamability.

The above compound solution contains fillers for imparting thixotropic properties. Example of fillers which can be used include clay, aluminum hydroxide, calcium carbonate, and the like. The content of the filler is from 5 to 100 parts by weight based on 100 parts by weight of the solid content of the above base resin.

Examples of the dispersant present in the above compound solution include low-molecular weight sodium polycarboxylate, sodium tripolyphosphate, and the like. The content of the dispersant preferably is from 0.2 to 2 parts by weight based on 100 parts by weight of the solid content of the above base resin.

Examples of the foam stabilizer present in the above compound solution include ammonium long-chain alkylcarboxylate, such as ammonium stearate or the like. The content of the foam stabilizer is preferably from 1 to 8 parts by weight based on 100 parts by weight of the solid content of the above base resin.

The compound solution can contain foaming assist agents. Examples of the foaming assist agent include a sodium dialkylsulfosuccinate. The content of the foaming assist agent preferably is from 1 to 7 parts by weight based on 100 parts by weight of the solid content of the above base resin.

The compound solution can contain thickeners for imparting thixotropic properties, together with the above fillers, to stabilize the formed cells. Examples of preferred thickeners include ammonium polyacrylate, polyacrylic acid, and the like. The amount of thickener preferably is from 0.5 to 5 parts by weight based on 100 parts by weight of the solid content of the above base resin.

In the present invention, when the base resin has self-crosslinkability to some extent, it cures with a lapse of time. When using a base resin whose curing rate is low, crosslinking agents preferably are added. Examples of the preferred crosslinking agent include isocyanates. The amount of crosslinking agent preferably is from 1 to 5 parts by weight based on 100 parts by weight of the solid content of the above base resin.

According to the properties of the base resin to be used, elasticizers preferably are added when cells (after forming a porous layer) are broken by pressure and walls of the cells are adhered and, as a result, the cells do not return to their original state. Examples of the preferred elasticizer include silicone oils. The amount of elasticizer is preferably from 0.5 to 1.5 parts by weight based on 100 parts by weight of the solid content of the above base resin.

The leather-like sheet structural material of the present invention is produced by using the above sheet structural material. The leather-like sheet structural material of the present invention is characterized by discontinuously forming a leather-like film layer on the porous layer of the above sheet structural material. That is, in the leather-like sheet structural material of the present invention, a leather-like concavo-convex surface is formed on the porous layer and, at the same time, a film layer is formed on only a convex portion of this concavo-convex surface. The air permeability of the leather-like sheet structural material of the present invention is from 3 to 13 $cm^3/cm^2/sec$.

The method of producing the sheet structural material and leather-like sheet structural material of the present invention is described hereafter. First, a nonwoven fabric as a supporting fabric is impregnated with an aqueous emulsion such as polyurethane, acrylic, or the like, and the aqueous emulsion was squeezed by using a mangle, followed by drying by using a dryer. In that case, pigments can be added in the above emulsion to impart variability to the color shade of the leather-like sheet structural material in a final product. The dried polymer-impregnated nonwoven fabric is wound to form a roll having a specified size by using a wind-up machine.

Then, the above compound solution is prepared. The dispersants, foam stabilizers, fillers, foaming assist agents, thickeners, elasticizers, crosslinking agents, etc., are optionally added to an emulsion or dispersion containing a base resin, and the mixture is sufficiently stirred to be well dispersed, thereby obtaining a stable compound solution. The solids content of the compound solution preferably is from 50 to 60% by weight. Such a compound solution with high solid content has a considerably high viscosity and is liable to gel, but has an advantage that it can be dried in a short time because of small water content.

Then, this compound solution is foamed by using a high-speed mixer, and air contained in the cells is as small as possible. The expansion ratio (ratio of volume after foaming to original volume of the compound solution) varies depending on the final product, but is preferably from 1.3 to 2.5. As a result of such high-speed mixing, the resulting compound solution has thixotropic properties.

Then, the compound solution foamed as described above is continuously applied on the above polymer-impregnated nonwoven fabric in a predetermined thickness by using a doctor knife coater. When the compound solution is applied by using a doctor knife, smoothing of the applied compound solution is caused by shear. The thickness of the compound solution to be applied is selected according to the leather-like sheet structural material obtained finally. Since the foamed compound solution has thixotropic properties, the compound solution becomes solid-like immediately before gelling when applied. The foamed structure of the compound liquid layer in this solid-like state is not easily broken, and is maintained even in the following drying step. It is considered that since this compound solution contains high solid content, the drying step is completed in a short time, which contributes to maintaining of the highly foamed structure.

Then, a porous layer is formed by drying the compound solution on the supporting fabric. In this drying step, in order to prevent breakage of the foamed state of the foamed compound solution, preferably only the surface is dried by first using far infrared radiation to form a thin dry surface film, followed by hot-air drying using a pin tenter dryer. It is decided based on the components of the compound solution or expansion ratio whether first heating using far infrared radiation is performed or not. In this drying step, since the foamed state is maintained as described above, the formed porous layer also maintains the foamed state. Retention of the foamed state can be confirmed by the fact that the thickness of the coated layer in a wet state after applying the compound solution and the thickness after drying are almost the same. The sheet structural material of the present invention can be obtained by evaporating water from the compound solution.

Figure 1B:
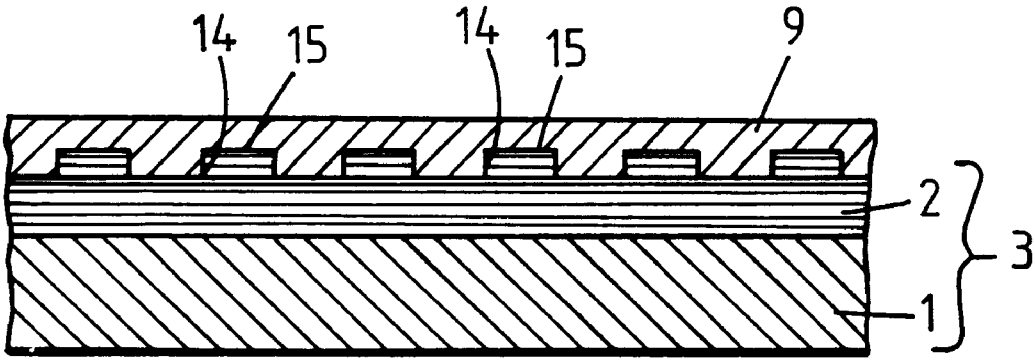
Fig. 1b (Prior Art)

The leather-like sheet structural material of the present invention is produced by using the sheet structural material in the same manner as that described in Japanese Patent Kokai Publication No. 8-232174, as shown in FIGS. 1(*a*) and 1(*b*). First, as shown in FIG. 1(*a*), a film material 15 is applied only to a concave portion 14 of a concavo-convex shape of a transfer paper 9 having the surface of a concavo-convex shape, which is reverse to the leather-like concavo-convex surface, to fill the concave portion with the film material. The film material 15 typically contains 10 to 30% of a resin, 5 to 10% of a pigment, and a solvent.

Figure 2:
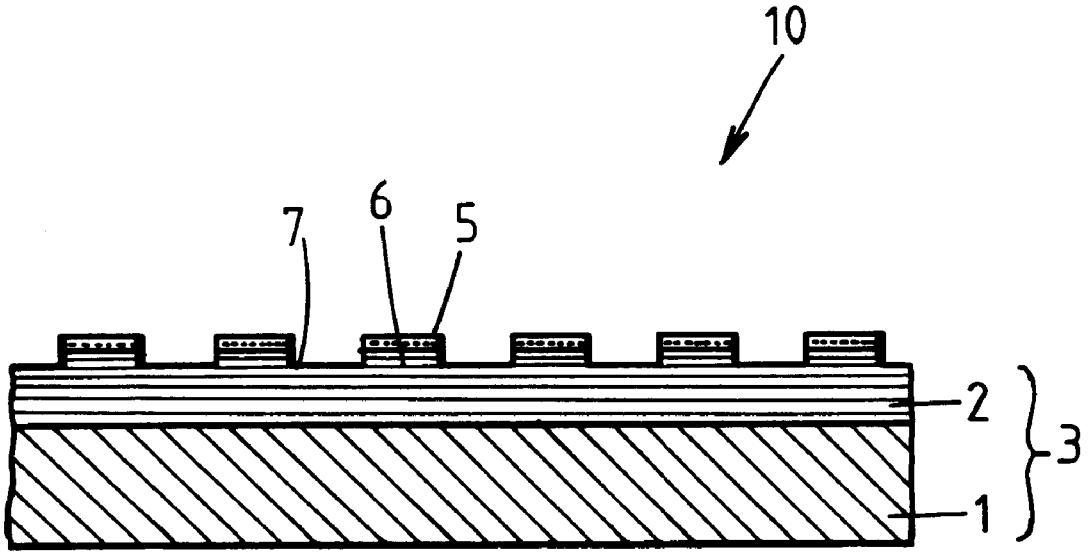
Fig. 2 (Prior Art)
FIG. 2 is a sectional view showing a leather-like sheet structural material of the present invention.

Then, the transfer paper 9, whose concave portion 14 is filled with the film material 15, is laid so that the surface coated with the film material 15, that is, the upper surface in FIG. 1(*a*), is brought into contact with a porous layer 2 of a sheet structural material 3, as shown in FIG. 1(*b*). The transfer paper 9 thus laid and sheet structural material 3 are pressed with heating by using a roller. By pressing with heating, the leather-like reverse concavo-convex shape of the transfer paper 9 is transferred to the sheet structural material 3 and, at the same time, a film material 15 (FIG. 1(*b*)) is transferred as a film layer 5 on a convex portion 6 of the transferred concavo-convex surface of the sheet structural material 3, as shown in FIG. 2. Thereafter, a leather-like sheet structural material 10 shown in FIG. 2 is obtained by cooling the transfer paper 9 and sheet structural material 3 and peeling off the transfer paper 9 from the sheet structural material 3. The sheet structural material 3 of this leather-like sheet structural material 10 comprises an air-permeable supporting fabric 1 and the porous layer 2 having open cells with a diameter within the range from 20 to 250 micrometer formed on the supporting fabric 1. Since the porous layer 2 has the leather-like concavo-convex surface and the film layer 5 is formed only on the convex portion 6 of this concavo-convex surface, high air permeability is obtained.

EXAMPLES

The present invention will become apparent to those skilled in the art from the following Examples.

Table 1 shows the composition of the compound solution used in the production of the sheet structural material and leather-like sheet structural material of the present invention, with respect to each Example. This compound solution is converted into a porous layer by foaming to form a formed material, applying it on the supporting fabric, and drying the foamed material.

TABLE 1

| | | Amount (parts by weight) | | | | | | |
|---|---|---|---|---|---|---|---|---|
| | Name of Compound | Example 1 | Example 2 | Example 3 | Example 4 | Example 5 | Example 6 | Example 7 |
| Base resin | Acrylic emulsion[1)] | 90(*) | 60(*) | 50(*) | 100(*) | 50(*) | — | — |
| | MBR latex[2)] | 10(*) | 20(*) | — | — | 10(*) | — | — |
| | Urethane dispersion[3)] | — | 20(*) | 50(*) | — | 40(*) | 100(*) | 100(*) |

TABLE 1-continued

| | Name of Compound | Amount (parts by weight) | | | | | | |
|---|---|---|---|---|---|---|---|---|
| | | Example 1 | Example 2 | Example 3 | Example 4 | Example 5 | Example 6 | Example 7 |
| Dispersant | Sodium polycarboxylate | 0.5 | 0.7 | 1.1 | 0.5 | 0.7 | 1.1 | 0.5 |
| Foam stabilizer | Ammonium stearate | 2.0 | 3.0 | 3.5 | 2.0 | 3.0 | 3.5 | 3.0 |
| Filler | Aluminum hydroxide | 15 | 10 | 10 | 15 | 10 | 10 | 20 |
| | Clay | — | 5 | 10 | — | 5 | 10 | — |
| Auxiliary Foaming Agent | Na dialkylsulfosuccinate | 2.0 | 1.8 | 2.1 | 2.0 | 1.8 | 2.1 | 2.0 |
| Thickener | Ammonium polyacrylate | 1.0 | 0.8 | 1.2 | 1.0 | 0.8 | 1.2 | 2.0 |
| Elasticizer | Silicone oil[4)] | — | — | — | 0.4 | 0.5 | 1.1 | 0.5 |
| Crosslinking Agent | Isocyanate[5)] | — | — | — | 2.0 | 2.0 | 3.0 | 3.0 |
| Foaming coefficient | | 2.5 | 2.5 | 2.2 | 2.2 | 2.0 | 1.54 | 1.4 |

(*): Solid content;
[1)]: Alkyl acrylate-acrylonitrile-carboxylic acid copolymer aqueous emulsion having the solid content of 60% by weight, NICASOL FX457 (manufactured by Nippon Carbide Kogyo Co.);
[2)]: Polymethylmethacrylate-butadiene copolymer latex having the solid content of 48% by weight, MBR LATEX 2M33A (manufactured by Takeda Yakuhin Kogyo Co.);
[3)]: INPLANEEL DLS having the solid content of 50% by weight (manufactured by Bayer Co.);
[4)]: Dimethylpolysiloxane, KF995 (manufactured by Shinetsu Silicone Co.);
[5)]: Hexamethylene diisocyanate, WB40-100 (manufactured by Asahi Kasei Kogyo Co.).

Figure 3A:
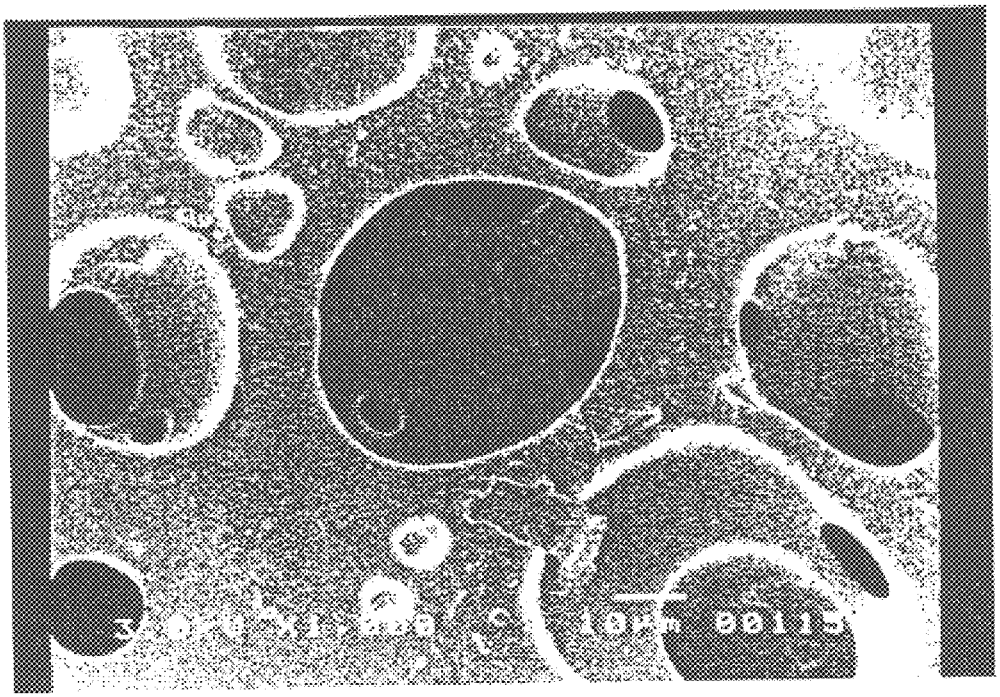
FIGS. 3(*a*) and 3(*b*) are electron micrographs of the surface and section of a sheet structural material as one example of the present invention, respectively, wherein the magnification of FIG. 3(*a*) is 1,000× and the magnification of FIG. 3(*b*) is 100×.
Figure 3B:
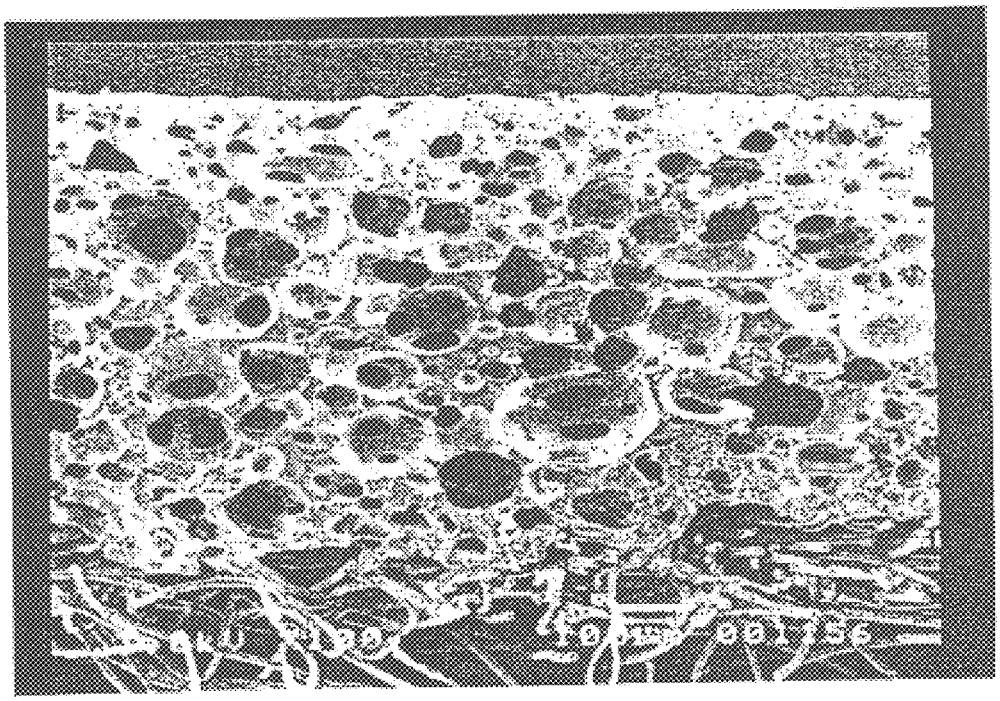
Figure 4A:
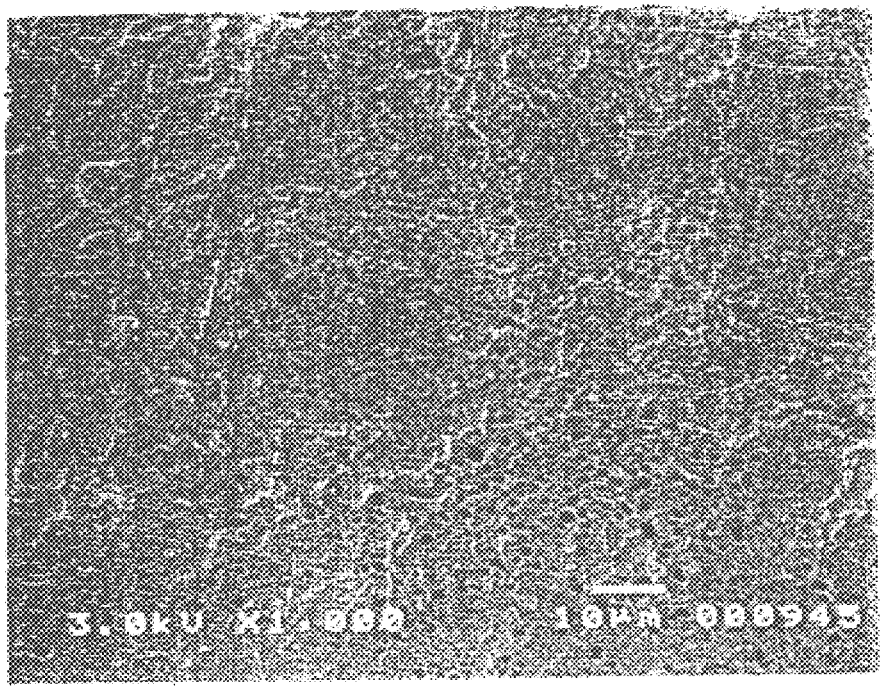
Fig. 4a (Prior Art)
FIGS. 4(*a*) and 4(*b*) are electron micrographs of the surface and section of an artificial leather of the prior art, respectively, wherein the magnification of FIG. 4(*a*) is 1,000× and the magnification of FIG. 4(*b*) is 100×.
Figure 4B:
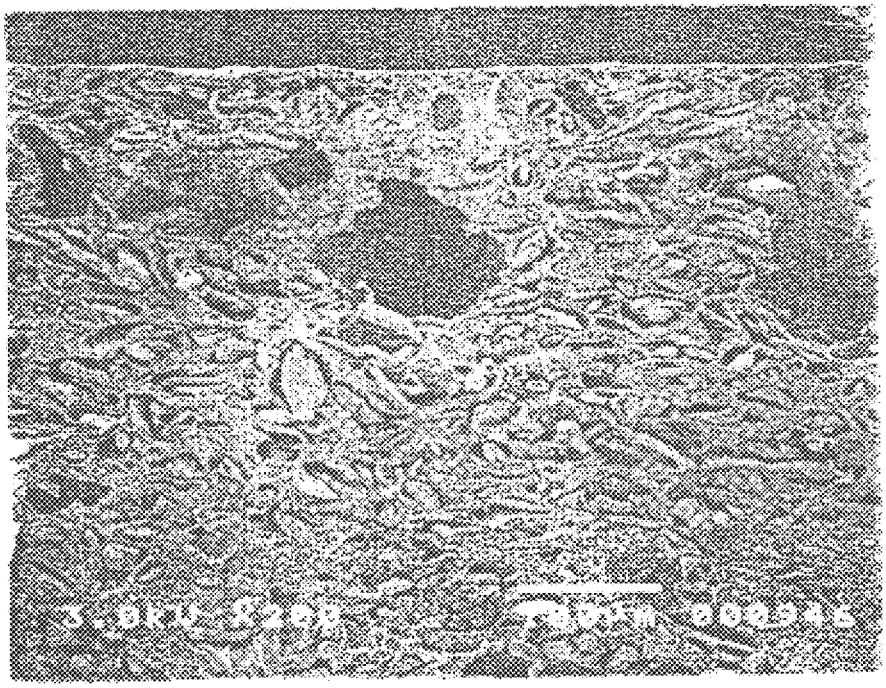
Fig. 4b (Prior Art)
Figure 5A:
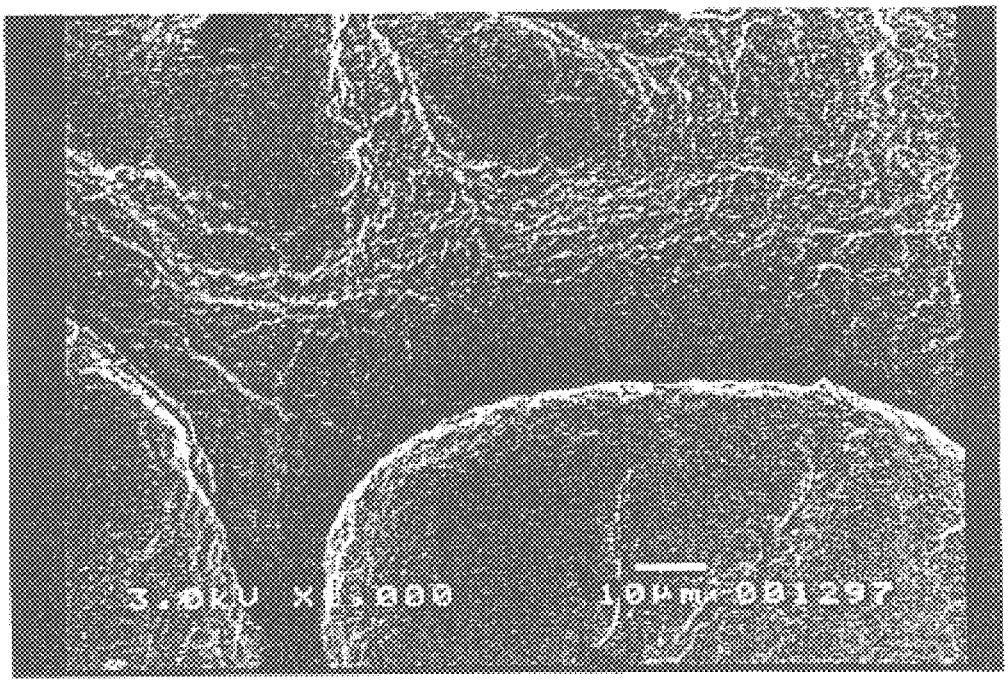
FIGS. 5(*a*) and 5(*b*) are electron micrographs of the surface and section of a natural leather, respectively, wherein the magnification of FIG. 5(*a*) is 1,000× and the magnification of FIG. 5(*b*) is 100×.
Figure 5B:
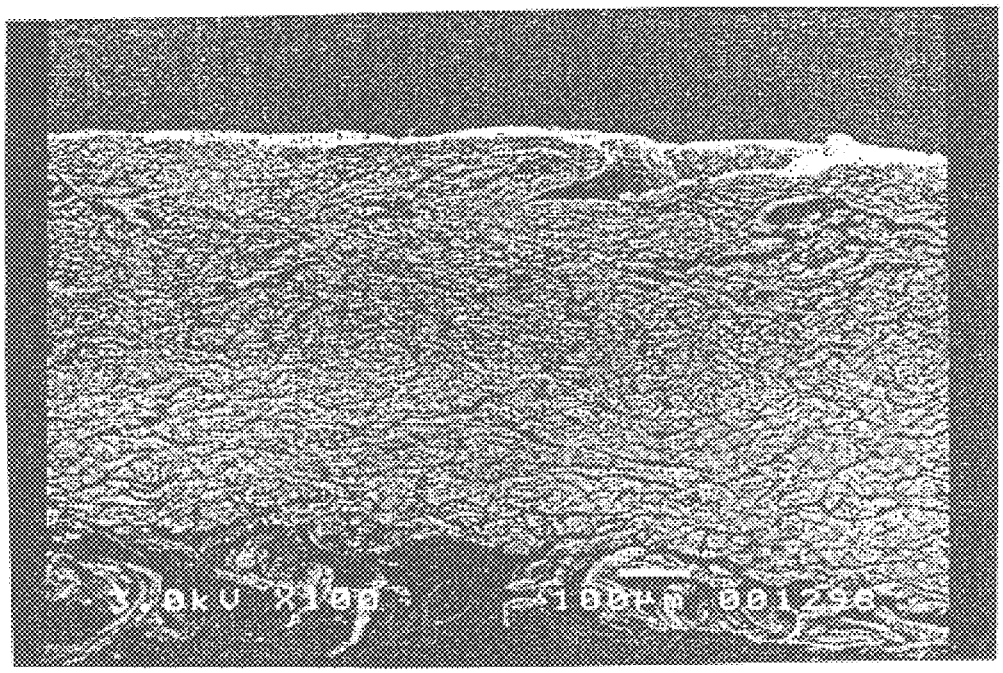

A sheet structural material was produced by using a compound solution of Example 1 in Table 1 and electron micrographs of the surface and section of the porous layer formed after the drying step were taken (FIGS. 3(*a*) and 3(*b*)). For comparison, electron micrographs (FIGS. 4(*a*) and 4(*b*)) of artificial leather of the prior art produced by using DMF, and electron micrographs (FIGS. 5(*a*) and 5(*b*)) of natural leather are taken.

As is apparent from electron micrographs shown in FIGS. 3(*a*) and 3(*b*), the diameter of cells formed in the leather-like structural material of the present invention is in the range from 20 to 250 micrometers. The formed cells are open cells, and the air permeability of the sheet structural sheet and leather-like sheet structural material of the present invention are improved by formation of these open cells. As is apparent from a comparison between FIG. 4, FIG. 5 and FIG. 3, open cells having a diameter within the range from 20 to 250 micrometer, like the sheet structural material of this Example, are not present in artificial leather of the prior art or in natural leather. Using the compound solutions of Examples 2 to 7, sheet structural materials were produced and their electron micrographs were taken (not shown). It has also been found that open cells having a diameter within the range from 20 to 250 micrometer are also formed in these sheet structural materials and these cells are also open cells, similar to FIGS. 3(*a*) and 3(*b*).

With respect to the sheet structural materials of Example 1 to 7 and to leather-like structural materials using these sheet structural materials, the air permeability was examined. For comparison, with respect to a sheet structural material of the prior art and natural leather, the air permeability of these materials was also examined. The results are shown in Table 2. The test method of the air permeability was performed according to JIS L-1096.

TABLE 2

| | Air Permeability ($cm^3/cm^2/sec$) | | | | | | | | |
|---|---|---|---|---|---|---|---|---|---|
| | Example 1 | Example 2 | Example 3 | Example 4 | Example 5 | Example 6 | Example 7 | Article of Prior Art | Natural Leather |
| Sheet structural material | 18.1 | 17.2 | 16.8 | 17.1 | 15.3 | 14.6 | 15.0 | 1 or less | — |
| Leather-like sheet structural material | 11.8 | 6.8 | 10.3 | 10.6 | 9.5 | 6.5 | 5.2 | — | 1 or less |

As a result, the air permeability of each of sheet structural materials of Examples 1 to 7 was noticeably superior to that of the sheet structural material of the prior art. The air permeability of each of leather-like sheet structural materials of the respective Examples also was noticeably superior to that of natural leather.

Among Example 1 to 7, Examples 6 and 7 are leather-like sheet structural materials suited for sport shoes, in which a high peeling strength between the supporting fabric and porous layer, and the high flexibility as artificial leather, are required. In order to measure the peeling strength of the sheet structural materials of Examples 6 and 7, a test was performed in the following manner. The sheet structural materials of Examples 6 and 7 were cut into two test pieces of 3 cm in width. These two test pieces were bonded with facing their porous layers each other, except for one end, by using an adhesive to obtain a sample. This sample was stretched at a constant rate (20 mm/min) with griping one nonadhered end by using a tensile tester, and then the tensile strength was measured. As a result, the tensile strength of both sheet structural materials of Example 6 and 7 was 7.5 Kg (2.5 Kg/cm). The touch of both sheet structural materials of Example 6 and 7 was soft and both structural materials had feeling suited for sports shoes. As is apparent from these results, sheet structural materials of Examples 6 and 7 can be used as artificial leather suited for sports shoes.

As described above, the sheet structural material of the present invention has superior air permeability than natural leather because open cells having a diameter of 20 to 250 micrometer are formed. According to the method of producing of the sheet structural material of the present invention, the above leather-like sheet structural material can be produced without using DMF. Therefore, environmental pollution problems do not arise. Furthermore, since the step of dipping in water to remove DMF is not required like the prior art, the sheet structural material can be obtained by a simple step of only drying with heating.

Regarding the leather-like structural material, since a film layer is formed only on the concave portion of the surface of the sheet structural material having excellent air permeability, as described above, the air permeability of the sheet structural material is not adversely affected. Accordingly, it is expected that the leather-like sheet structural material of the present invention improves the air permeability of the leather-like sheet structural material of the prior art and further provides superior air permeability compared to natural leather, thereby providing uses on leather-like sheet structural material that has not been found in the prior art.

What is claimed is:

1. A sheet structural material comprising an air-permeable supporting fabric and a porous layer formed on said supporting fabric, wherein said porous layer is formed by applying a foamed material having a thixotropy index of 2 to 4 obtained by foaming a compound solution comprising a base resin and a filler at an expansion ratio of from 1.3 to 2.5 and drying the foamed material, and wherein said porous layer has open cells having a diameter of from 20 to 250 micrometers.

2. The sheet structural material of claim 1 wherein the air permeability is from 10 to 20 $cm^3/cm^2$ sec.

3. The sheet structural material of claim 1 wherein the viscosity of the foamed material is from 5,000 to 35,000 centipoises.

4. The sheet structural material of claim 1 wherein the viscosity of the compound solution is from 5,000 to 30,000 centipoises.

5. The sheet structural material of claim 1 wherein the base resin is polyurethane, and the expansion ratio of the compound solution is from 1.4 to 1.7.

6. A sheet structural material comprising an air-permeable supporting fabric, a porous layer formed on said supporting fabric, and a film layer formed on said porous layer, wherein said porous layer is formed by applying a foamed material having a thixotropy index of 2 to 4 obtained by foaming a compound solution comprising a base resin and a filler at an expansion ratio of from 1.3 to 2.5 and drying the foamed material, wherein said porous layer has open cells having a diameter in a range from 20 to 250 micrometers, and wherein a concavo-convex surface is formed on the surface of said porous layer and a film layer is formed on a convex portion of said concavo-convex surface.

7. The leather-like sheet structural material of claim 8 wherein the air permeability is from 3 to 13 $cm^3/cm^2/sec$.

8. The leather-like sheet structural material of claim 6 wherein the viscosity of the foamed material is from 5,000 to 35,000 centipoises.

9. The leather-like sheet structural material of claim 6 wherein the viscosity of the compound solution is from 5,000 to 30,000 centipoises.

10. The leather-like sheet structural material of claim 6 wherein the base resin is polyurethane and the expansion ratio of the compound solution is from 1.4 to 1.7.

11. A method of producing a sheet structural material comprising a drying step of drying a foamed material having a thixotropy index of 2 to 4, which is obtained by foaming a compound solution comprising a base resin and a filler at an expansion ratio of from 1.3 to 2.5, to form a porous layer on an air-permeable supporting fabric.

12. The method of producing the sheet structural material of claim 11 further comprising:

an applying/filling step of applying a film material for forming a film layer on a transfer paper having a concavo-convex shape, which is reverse to a concavo-convex surface, to fill a concave portion of said concavo-convex shape with said film material; and a transferring step of laying said transfer paper on said sheet structural material so as to contact with the surface coated with said film material, transferring the shape of the concavo-convex surface of said transfer paper onto said sheet structural material with pressing, and transferring said film material filled in the concave portion of the concavo-convex shape of said transfer paper onto the convex portion of the shape of said concavo-convex surface transferred onto said sheet structural material.

* * * * *